United States Patent [19]

Farmer et al.

[11] 4,386,957

[45] Jun. 7, 1983

[54] PROCESS FOR MAKING NONMAGNETIC STEEL

[75] Inventors: Audley J. Farmer, Kent; Robert B. Moffett; Thomas R. Carney, both of Seattle, all of Wash.

[73] Assignee: Earle M. Jorgensen Co., Seattle, Wash.

[21] Appl. No.: 210,855

[22] Filed: Nov. 26, 1980

[51] Int. Cl.[3] ..... C21C 5/32; C21C 5/34

[52] U.S. Cl. ..... 75/51; 75/59; 75/60

[58] Field of Search ..... 75/51, 52, 59, 60, 130.5, 75/229

[56] References Cited

U.S. PATENT DOCUMENTS

| | | | |
|---|---|---|---|
| 16,082 | 11/1856 | Bessemer | 75/60 |
| 3,169,058 | 2/1965 | Nelson | 75/59 |
| 4,160,664 | 7/1979 | Maruhashi | 75/60 |
| 4,168,158 | 9/1979 | Iwaoka | 75/60 |
| 4,170,467 | 10/1979 | Kaito | 75/60 |
| 4,174,212 | 11/1979 | Bauer | 75/60 |

*Primary Examiner*—P. D. Rosenberg

*Attorney, Agent, or Firm*—Seed, Berry, Vernon & Baynham

[57] ABSTRACT

A method of making a nonmagnetic, austenitic, manganese-chromium-nickel-nitrogen stainless steel uses intermediate addition of ferroalloys and novel mixtures of oxygen and nitrogen to maintain the temperature of the melt below about 3150° F. (1732° C.). The method improves on the economics of making specialty steels by reducing the cost of raw materials and refractories.

39 Claims, No Drawings

PROCESS FOR MAKING NONMAGNETIC STEEL

DESCRIPTION

TECHNICAL FIELD

This invention relates to a novel method for making steel. More particularly, it relates to a novel method for making a nonmagnetic, austenitic, manganese-chromium-nickel-nitrogen stainless steel. The method uses a novel injection pattern for decarburization with oxygen and nitrogen.

BACKGROUND ART

Traditionally, the method of making nonmagnetic, austenitic stainless steel is to melt raw materials in an electric arc furnace to form a melt having between about 6–7% manganese. After transfer to an Argon Oxygen Decarburization (AOD) vessel, injection of oxygen and nitrogen mixtures having the ratio of oxygen to nitrogen of 3:1 and 1:1 (by volume) removes carbon from the melt by selectively oxidizing the carbon. After slagging off, ferroalloys are melted in to reach the desired final analysis. This process usually employs a temperature of about 3300° F. (1816° C.). At least, it typically uses a temperature well above the 3150° F. (1732° C.) at which refractories break down.

In U.S. Pat. No. 3,082,083, Levy et al. disclose an alloy of stainless steel useful for producing drill collars. The alloy is strong, tough, corrosion-resistant, wear-resistant, and free of magnetic effects under the conditions encountered in actual, practical use. This alloy is significantly less expensive than other alloys, such as Monel-K. The alloy is a carbon, manganese, nickel, chromium, nitrogen, iron steel made in an electric arc furnace.

In U.S. Pat. No. 3,112,195, Souresny discloses a drill stem made from non-magnetizable, austenitic, manganese-chromium alloy steels. A particular alloy of carbon, silicon, manganese, chromium, nitrogen steel is cold-worked into a drill collar. The steel may have tungsten, titanium, columbium, tantalum, boron, vanadium, copper, and cobalt, individually or jointly, as additives.

DISCLOSURE OF INVENTION

The preferred method of this invention reduces the carbon content of a melt while maintaining the temperature of the melt no greater than about 3150° F. (1732° C.). To reduce the temperature, ferroalloys are added at an intermediate stage rather than only after the carbon content has been reduced. Also, a novel method of injecting a mixture of oxygen to nitrogen where nitrogen is the greater component of the mix (by volume) is used to maintain the temperature below about 3150° F. (1732° C.). Preferably, two steps of injection are used. First, a mixture of about 1:3 oxygen to nitrogen (by volume) is used to reduce the carbon content to about 0.12%. A second step uses a mixture of about 1:8 oxygen to nitrogen (by volume) to reduce the carbon content to about 0.05%. Although the decarburization may be completed at any temperature at which the steel is molten, the method of this invention prefers to maintain the temperature no less than about 2950° F. (1621° C.) and no greater than about 3150° F. (1732° C.).

BEST MODE FOR CARRYING OUT THE INVENTION

For purposes of this description, ratios of gases ($O_2$:$N_2$ or $N_2$:Ar) shall be given on a volume (molar) basis. This method for making a nonmagnetic, austenitic, manganese-chromium-nickel-nitrogen stainless steel preferably melts raw materials in an electric arc furnace under reducing conditions to form an initial melt having about 5.5–8.0% manganese, 14–17% chromium, 1.0–2.5% nickel, and 0.8–1.5% carbon. Enough silicon and carbon should be present in the charge to guarantee that the meltdown is conducted under reducing conditions. Burned lime (CaO) is added to the melt. About 50–60 pounds of lime/ton of melt is typically added to aid the ensuing reactions. Once melted, the mixture is transferred from the electric arc furnace to an Argon Oxygen Decarburization (AOD) vessel. Ferroalloys and scrap stainless steel are suitable raw materials with which to charge to the electric arc furnace.

In the AOD vessel, mixtures of oxygen and nitrogen are injected through the tuyeres to reduce the carbon content of the melt to acceptable levels. The method of this invention monitors the temperature of the melt during the injections to assure that the temperature reaches no greater than about 3150° F. (1732° C.). Various ratios of oxygen to nitrogen are used to regulate the temperature. Also, ferroalloys may be added at an intermediate stage in the decarburization to cool the melt. The ferroalloys absorb heat from the melt to overcome their latent heats while melting.

Initially, the oxygen-to-nitrogen ratio is preferably about 3:1. This injection continues until the carbon content of the melt is reduced to about 0.50% by weight. Typically, ferroalloys will be added to the melt after this injection. The additives are used to adjust the chromium, nickel, and molybdenum content of the steel as well as to keep the melt temperature below about 3150° F. (1732° C.). Chromium is adjusted to a range of about 12.25–14.0% by weight based on the projected tap weight. About 13.0% chromium is preferred. Nickel should achieve a range of about 1.75–2.75% by weight of the projected tap weight of the melt. Preferably, the nickel content will be about 2.10%. Molybdenum content is adjusted to the range of 0.4–0.6% by weight based on the projected tap weight, with 0.5% as the preferred amount. Prior to this addition, the temperature of the melt preferably is maintained at no less than about 3000° F. (1649° C.). If the temperature drops too low, the melting process is unduly long. As with all steps of this method, the temperature maximum is about 3150° F. (1732° C.).

Once the ferroalloys have melted in to achieve the desired analysis, about a 1:1 mixture of oxygen to nitrogen is injected to further reduce the carbon content to about 0.30% by weight. Then, a mixture of about 1:3 oxygen to nitrogen is used to reduce the carbon content to about 0.12%. Finally, the mixture of oxygen to nitrogen is adjusted to about a 1:8 ratio and the injection continues until the carbon content reaches about 0.05% by weight. This final injection, rich in nitrogen, is important if the carbon content is to be reduced without exceeding 3150° F. (1732° C.). A rich oxygen mix usually will raise the temperature to about 3300° F. (1816° C.), which is above the breakdown temperature for the refractories. In the typical decarburization, a new lining of refractories is necessary for the vessel about each seven heats. However, with the novel method of this invention, twenty or more heats may be run before the refractories must be changed. There are significantly fewer down times for the plant while refractories are being relaid in the vessels. Furthermore, intermediate addition of ferroalloys to cool the melt allows cheaper alloys to be used, further adding to the economic advantages of this method At completion of the decarburization (through selective oxidation), a reduction mixture is added to the melt. Preferably, between about 50–60 pounds of burned lime/ton of melt are added, along with ferro-manganese-silicon, silico-manganese, and ferro-silicon to adjust the manganese content to about 8.5–12% by weight and the silicon content to about 0.7%. The additions may be simultaneous or consecutive. Preferably, the burned lime is added first. At a temperature of between about 2950°–3050° F. (1621°–1677° C.), the melt is stirred with nitrogen for about five minutes. During this stirring, the additives melt, mix, and react with the decarburized melt. If the temperature is not within the desired range, the time for stirring need be adjusted. Standard thermodynamic formulae will allow those skilled in the art to calculate the desired time as a function of temperature.

After the additives react with the melt adequately, the slag is removed from the melt. A desulfurizing slag is formed by adding about 30 pounds of burned lime/ton of melt. The nitrogen stirring is then continued; electrolyte manganese is added to adjust the content to the range of about 17–19% by weight. Preferably, manganese comprises about 18% of the final melt. Furthermore, other ferroalloys are added to bring the steel into the desired final specifications. A preferred steel for use in drill collars has an analysis of at most 0.10% carbon, about 17–19% manganese, at most 0.75% silicon, about 1.75–2.25% nickel, about 12.25–14.0% chromium, about 0.4–0.6% molybdenum, at least 0.2% nitrogen, the remainder being essentially iron. A more preferred steel has an analysis of about 0.06% carbon, about 18% manganese, about 0.40% silicon, about 2.10% nickel, about 13% chromium, about 0.50% molybdenum, and about 0.30% nitrogen, the remainder being substantially iron. To either of these final steels, phosphorus may be an impurity having a maximum content of about 0.035% by weight. Similarly, sulfur should not exceed about 0.020% of the final steel. Columbium is preferably added to reduce corrosion-stress cracking in the steel. If added, the columbium content should be at least about four times the carbon content. Nitrogen should be maintained low enough to avoid rupturing of the steel in use. To maintain the level near the desired 0.2–0.3% range, the nitrogen stirring can be altered to use a mixture of argon and nitrogen. Pure argon will leach nitrogen from the melt, so a ratio of about 1:1 argon to nitrogen is preferred. The ratio of argon to nitrogen may be adjusted to achieve the desired results of adding or removing nitrogen from the melt. One skilled in the art, with limited experimentation, will soon be able to achieve a desired ratio. The final additions of burned lime, electrolytic manganese, and ferroalloys may be done simultaneously, while nitrogen stirring continues. The temperature is monitored throughout this refinement to allow for the chill effect of the final additions. To tap, the temperature must be above about 2690° F. (1477° C.). When the steel reaches the desired chemical composition, the melt is ready for tapping.

This description has concentrated on a preferred method for making a nonmagnetic, austenitic, manganese-chromium-nickel-nitrogen stainless steel. Numerous modifications are possible in this method without departing from the inventive concept discovered in this method. Also, portions of the overall method are novel and useful in themselves. Therefore, this invention should not be limited to the preferred method described unless limitation is required by the scope of the prior art or by the nature and spirit of the appended claims.

What is claimed is:

1. A method for reducing carbon content in a melt, comprising the steps of injecting a 1:3 mixture of oxygen to nitrogen (by volume) into the melt to reduce the carbon content to about 0.12%, followed by injecting a 1:8 mixture of oxygen to nitrogen (by volume) to reduce further the carbon content.

2. The method of claim 1 wherein the temperature of the melt is maintained at a temperature no greater than about 3150° F. (1732° C.).

3. The method of claim 2 wherein the temperature of the melt is maintained at a temperature no less than about 2950° F. (1621° C.).

4. The method of claim 1 wherein the melt has an initial carbon content of about 0.30%.

5. A method for reducing carbon content in a melt, comprising the steps of:

(a) injecting a 1:1 mixture of oxygen to nitrogen (by volume) into the melt to reduce the carbon content to about 0.30%;

(b) injecting a 1:3 mixture of oxygen to nitrogen (by volume) into the melt to reduce the carbon content to about 0.12%;

(c) injecting a 1:8 mixture of oxygen to nitrogen (by volume) into the melt to reduce further the carbon content.

6. The method of claim 5 wherein the temperature of the melt is maintained at no greater than about 3150° F. (1732° C.).

7. The method of claim 6 wherein the temperature of the melt is maintained at no less than about 2950° F. (1621° C.).

8. The method of claim 5, further comprising the step of initially injecting a 3:1 mixture of oxygen to nitrogen (by volume) into the melt to reduce the carbon content to about 0.50%.

9. The method of claim 8 wherein the melt has an initial carbon content of between about 0.8–1.5%.

10. A method of decarburizing steel, comprising the steps of injecting a mixture of oxygen and nitrogen wherein nitrogen is greater than 50% of the mixture (by volume) and maintaining the temperature of the melt no greater than about 3150° F. (1732° C.).

11. The method of claim 10, further comprising the step of adding ferroalloys during the decarburization to keep the temperature no greater than about 3150° F. (1732° C.).

12. A method for decarburizing steel, comprising the steps of injecting mixtures of oxygen and nitrogen in stages of 3:1, 1:1, 1:3, and 1:8 (by volume) to reduce the carbon content while maintaining the temperature no greater than about 3150° F. (1621° C.).

13. The method of claim 12 wherein the carbon content of the initial melt is between about 0.8–1.5%.

14. The method of claim 12 wherein the final carbon content of the melt is about 0.05%.

15. The method of claim 5 or claim 8 wherein the initial melt has an analysis of between about 5.5–8.0% manganese, 14–17% chromium, 1.0–2.5% nickel, and 0.8–1.5% carbon.

16. A method for making a nonmagnetic, austenitic, manganese-chromium-nickel-nitrogen stainless steel, comprising the steps of:

(a) melting under reducing conditions raw materials to form a melt having an initial analysis of between about 5.5–8.0% manganese, 14–17% chromium, 1.0–2.5% nickel, and 0.8–1.25% carbon;

(b) injecting into the melt about a 3:1 mixture of oxygen to nitrogen (by volume) to reduce the carbon content to about 0.50%;

(c) adding ferroalloys to the melt to raise the content of chromium to at least about 12.25%, of nickel to at least about 1.75%, and molybdenum to at least about 0.4% based on the projected tap weight;

(d) injecting into the melt about a 1:1 mixture of oxygen to nitrogen (by volume) to reduce the carbon content to about 0.30%;

(e) injecting into the melt about a 1:3 mixture of oxygen to nitrogen (by volume) to reduce the carbon content to about 0.12%;

(f) injecting into the melt about a 1:8 mixture of oxygen to nitrogen (by volume) to reduce the carbon content to about 0.05%;

(g) adding a reduction mix of burned lime, ferro-manganese-silicon, silico-manganese, and ferro-silicon to adjust the manganese content to about 8.5% and the silicon content to about 0.70%;

(h) stirring the melt with nitrogen;

(i) removing the slag from the melt after the additives are melted, mixed, and reacted;

(j) adding burned lime to the melt to form a desulfurizing slag;

(k) adding manganese to the melt while stirring to adjust the manganese content to about 17%; and (l) adding ferroalloys to the melt while stirring with nitrogen to produce a steel having an analysis of:
at most 0.10% carbon,
about 17–19% manganese,
at most 0.75% silicon,
about 1.75–2.25% nickel,
about 12.25–14.0% chromium,
about 0.4–0.6% molybdenum,
at least 0.2% nitrogen, and
the remainder substantially iron.

17. The method of claim 16 wherein the final analysis
about 0.06% carbon,
about 18% manganese,
about 0.40% silicon,
about 2.10% nickel,
about 13% chromium,
about 0.50% molybdenum,
about 0.30% nitrogen, and
the remainder substantially iron.

18. The method of claim 16 or claim 17 wherein the final analysis further has, at most, 0.035% phosphorus and 0.020% sulfur.

19. The method of claim 18 wherein the final analysis further has columbium with a content at least four times the carbon content.

20. The method of claim 16, further comprising the step of maintaining the nitrogen content at the desired level by injecting a mixture of nitrogen and argon.

21. The method of claim 20 wherein the ratio of nitrogen to argon is about 1:1 (by volume).

22. The method of claims 16, 17 or 20 wherein the temperature of the melt reaches no greater than about 3150° F. (1732° C.).

23. The method of claim 22 wherein the temperature of the melt reaches no less than about 2950° F. (1621° C.).

24. The method of claim 22 wherein the temperature of the melt before adding the ferroalloys of step c is no less than about 3000° F. (1649° C.).

25. The method of claim 24 wherein the temperature of the melt after the additions of step g is between about 2950–3050° F. (1621°–1677° C.).

26. The method of claim 16 wherein steps j, k, and l are done simultaneously.

27. The method of claim 16 wherein, in making the reduction mix of step f, between about 50–60 pounds of burned lime/ton of melt are added.

28. The method of claim 16 or claim 27 wherein the desulfurizing slag of step j is formed by adding about 30 pounds of burned lime/ton of melt.

29. The method of claim 16 wherein step g comprises two separate additions: one of burned lime to make a reduction mix and one of ferroalloys to adjust the manganese and silicon content of the melt.

30. The method of claim 16, further comprising the step of transferring the initial melt to an Argon Oxygen Decarburization vessel.

31. The method of claim 16 or claim 30 wherein the raw materials are melted in an electric arc furnace.

32. A method of maintaining the temperature of a melt no greater than 3150° F. (1732° C.) while decarburizing the melt, comprising the step of periodically adding ferroalloys to the melt while decarburizing the melt wherein the ferroalloy additives maintain the temperature of the melt at a temperature no greater than about 3150° F. (1732° C.).

33. The method of claim 16 wherein step j is performed prior to step k.

34. A method of increasing the life of refractory linings of vessels used to reduce the carbon content of a melt, comprising the step of:

injecting a mixture of oxygen and nitrogen into the melt at a ratio of the two gases which is sufficient to maintain the temperature of the melt in a range which allows the desired decarburization of the melt to be accomplished in a reasonable period of time but which maintains the temperature at all times no greater than about 3150° F. (1732° C.).

35. The method of claim 34, further comprising the step of:

adding ferroalloys during decarburization of the melt to aid in maintaining the melt temperature within the range, but at all times no greater than 3150° F. (1732° C.).

36. The method of claim 35 wherein the mixture of oxygen to nitrogen is adjusted during the decarburization from an initial ratio of about 1:1 oxygen to nitrogen (by volume) to a ratio of about 1:8 oxygen to nitrogen (by volume), thereby maintaining the temperature of the melt through oxygen dilution at no greater than about 3150° F. (1732° C.).

37. A method for making a nonmagnetic, austenitic, manganese-chromium-nickel-nitrogen stainless steel, comprising the steps of:

(a) melting raw materials under reducing conditions to form a melt having an initial analysis of between about 5.5–8.0% manganese, 14–17% chromium, 1.0–2.5% nickel, and 0.8–1.25% carbon;

(b) injecting about a 3:1 mixture of oxygen to nitrogen (by volume) into the melt to reduce the carbon content to about 0.50%;

(c) adding ferroalloys to the melt to raise the content of chromium to at least about 12.25%, of nickel to at least about 1.75%, and molybdenum to at least about 0.4% based on the projected tap weight;

(d) injecting about a 1:1 mixture of oxygen to nitrogen (by volume) into the melt to reduce the carbon content to about 0.30%;

(e) injecting about a 1:3 mixture of oxygen to nitrogen (by volume) into the melt to reduce the carbon content to about 0.12%;

(f) injecting about a 1:8 mixture of oxygen to nitrogen (by volume) into the melt to reduce the carbon content to about 0.05%;

(g) adding a reduction mix of burned lime, ferromanganese-silicon, silico-manganese, and ferro-silicon to adjust the manganese content to about 8.5% and the silicon content to about 0.70%;

(h) stirring the melt with nitrogen;

(i) removing the slag from the melt after the additives are melted, mixed, and reacted;

(j) adding manganese to the melt, while stirring, to adjust the manganese content to about 17%; and (k) adding ferroalloys, while stirring with nitrogen, to produce a steel having a final analysis of:
about 0.6% carbon,
about 18% manganese,
about 0.40% silicon,
about 2.10% nickel,
about 13% chromium,
about 0.50% molybdenum,
about 0.30% nitrogen,
at most 0.035% phosphorus,
at most 0.020% sulfur, and
the remainder substantially iron.

38. The method of claim 37 wherein the temperature of the melt is maintained at no greater than about 3150° F. (1732° C.).

39. The method of claim 38 wherein the temperature of the melt is maintained at no less than about 2950° F. (1621° C.).

* * * * *